US010060431B2

(12) United States Patent
Barron

(10) Patent No.: US 10,060,431 B2
(45) Date of Patent: Aug. 28, 2018

(54) METERING PUMP MADE OF PLASTIC

(71) Applicant: Robert Bosch GmbH, Stuttgart (DE)

(72) Inventor: Dan Barron, Schaffhausen (CH)

(73) Assignee: Robert Bosch GmbH, Stuttgart (DE)

( * ) Notice: Subject to any disclaimer, the term of this patent is extended or adjusted under 35 U.S.C. 154(b) by 429 days.

(21) Appl. No.: 14/390,818

(22) PCT Filed: Feb. 14, 2013

(86) PCT No.: PCT/EP2013/052988
§ 371 (c)(1),
(2) Date: Oct. 6, 2014

(87) PCT Pub. No.: WO2013/149750
PCT Pub. Date: Oct. 10, 2013

(65) Prior Publication Data

US 2015/0056063 A1 Feb. 26, 2015

(30) Foreign Application Priority Data

Apr. 4, 2012 (DE) ..... 10 2012 205 568

(51) Int. Cl.
*F04C 2/24* (2006.01)
*F04C 2/12* (2006.01)
(Continued)

(52) U.S. Cl.
CPC ..... *F04C 2/24* (2013.01); *F04B 13/02* (2013.01); *F04C 2/12* (2013.01); *F04C 2/123* (2013.01); *F04C 2/126* (2013.01); *F04D 1/003* (2013.01)

(58) Field of Classification Search
CPC ..... F04D 1/003; F04B 13/02; F04C 2/123; F04C 2/12; F04C 2/126; F04C 2/24; F04C 2/28; F04C 18/24; F04C 18/28
(Continued)

(56) References Cited

U.S. PATENT DOCUMENTS 3,054,417 A 9/1962 Corvisier
4,090,262 A 5/1978 Schneider et al.
(Continued)

FOREIGN PATENT DOCUMENTS

DE 10200804544 A1 * 3/2010
EP 1892417 2/2008
(Continued)

OTHER PUBLICATIONS

International Search Report for Application No. PCT/EP2013/052988 dated Apr. 24, 2013 (English Translation, 3 pages).

*Primary Examiner* — Justin Seabe
*Assistant Examiner* — Brian P Wolcott
(74) *Attorney, Agent, or Firm* — Michael Best & Friedrich LLP

(57) ABSTRACT

The invention relates to a metering pump (1) made of plastic, with two rotors (10) coupled to one another via gears (11) and drivable in opposite directions, which are seated in a pump housing (5) equipped with suction ports (6) and outlet ports (7), wherein each rotor (10) has a rotor shaft (12), the rotor shaft ends (15) of which are seated in the walls (8, 4) of the pump housing (5). Each rotor (10) has two rotor blade walls (13) arranged diametrically on the rotor shaft (12), a partially cylindrical rotor blade shoe (14) being formed at each of the peripheral ends of said rotor blade walls, wherein the rotor blade shoes (14) on the one hand contact the cylindrical inside wall regions of the pump housing (5) and on the other contact the rotor blade shafts (13) of the adjacent rotor (10) in a sliding and sealing manner.

12 Claims, 4 Drawing Sheets

(51) Int. Cl.
*F04B 13/02* (2006.01)
*F04D 1/00* (2006.01)

(58) Field of Classification Search
USPC ..... 417/410.3, 410.4
See application file for complete search history.

(56) References Cited

U.S. PATENT DOCUMENTS

| | | | | |
|---|---|---|---|---|
| 5,180,299 | A | 1/1993 | Feuling | |
| 6,343,724 | B1 * | 2/2002 | Ophardt | A47K 5/1202 137/543.23 |
| 7,857,607 | B2 * | 12/2010 | Bishop | F04C 2/126 418/1 |
| 2008/0304981 | A1 * | 12/2008 | Chuang | F04C 18/126 417/410.4 |
| 2009/0046958 | A1 * | 2/2009 | Keen | B65D 51/226 383/202 |
| 2009/0191078 | A1 * | 7/2009 | Colombo | F01D 25/20 418/9 |
| 2009/0304540 | A1 | 12/2009 | Whittome et al. | |

FOREIGN PATENT DOCUMENTS

| | | | | |
|---|---|---|---|---|
| EP | 2085616 | | 8/2009 | |
| FR | 2226874 | A5 * | 11/1974 | F04C 2/123 |
| WO | 9524556 | | 9/1995 | |

* cited by examiner

METERING PUMP MADE OF PLASTIC

BACKGROUND OF THE INVENTION

The present invention relates to a metering pump, made of plastic, comprising two rotors, which are coupled to one another via gearwheels and are drivable in opposite directions and which are mounted in a pump housing provided with suction ports and outlet ports, wherein each rotor has a rotor shaft, the rotor shaft ends of which are seated in the walls of the pump housing.

Metering pumps are known in all sizes and construction types. As plastics metering pumps are known, in particular, manually actuated piston pumps, as are known on soap dispensers for liquid soaps or, as here particularly of interest, also in the hotel and catering industry, where in fast food establishments, for instance, mustard, ketchup or even coffee cream are delivered in metered doses with manually operated piston pumps of this kind Despite these metering pumps, the delivered quantity nevertheless varies relatively, since, in the metering pumps, in particular of the kind as here just described, the stroke length should actually be fully utilized with each actuation, though this is not generally the case. Instead, one, two or three short strokes are often made and, accordingly, the quantity varies very strongly. As long as this quantity is delivered merely as accompaniment to a hamburger, this is only of minor importance. Where such metering pumps are also used to add a specific quantity of a liquid food to a recipe, however, the taste is varied by incorrect actuation, which is not always appreciated by the customers.

Although a variety of different pumps are certainly known, in particular including rotor pumps, these are generally designed as relatively high-precision metering pumps, made of metal, and this is also necessary in the food industry, where large quantities must be delivered in metered doses. For commercial application, normally very cheap disposable metering pumps are delivered, however, generally free of charge. Accordingly, such metering pumps must be made of plastic, have a simplest possible construction and work reliably.

The plastics metering pump which is here of interest is meant to be designed, in particular, for foods which are delivered in so-called tubular bags or other flexible packagings made of plastics sheets.

Many liquid foods also contain considerable proportions of solids. Typical examples of liquid foods of this kind are, for instance, tartare sauce, mustard sauces with pickles, custard with chocolate or with almond slivers, etc. With the currently standard metering pumps, solid-liquid foods of this kind cannot be delivered in metered doses. In so-called gear pumps, in particular, of the kind which is represented, for instance, in FR-2313971, this is barely realizable. In the case of larger solid particles, such as, for instance, almond sticks, these are ground by the rotors or jam the rotors. Accordingly, for such metering pumps, in particular metering pumps in which the rotors have two or multibladed rolling elements can be considered. Examples of such pumps are known from U.S. Pat. No. 3,054,417, where a metering pump for liquid mediums for the admixture of further liquids is shown, wherein each rotor here has three blade arms and these blade arms roll one against another and thus advance the medium. In such pumps, there is sufficient space between the housing and the individual rotor blades to convey also liquids which contain solid parts. Here, the larger solid parts are less of a problem than, in fact, the smaller solid parts, which remain stuck on the rotor blades which mutually roll one against another and in the rolling operation are completely crushed, whereupon a coating can form which reduces the pumping capacity and can even lead to blockages.

The same also applies to a metering pump according to WO 95/24556, in which merely twin-bladed rotors are represented, which likewise, however, roll mutually both one against the other and against the housing wall.

SUMMARY OF THE INVENTION

The object of the present invention is consequently to provide an improved metering pump which has a relatively large pumping capacity and is particularly suitable for the pumping of solid-liquid mixtures, without at the same time having the previously described drawbacks.

This object is achieved by a plastics metering pump of the type stated in the introduction, which is distinguished by the fact that each rotor has two rotor blade walls, which are disposed diametrically on the rotor shaft and onto the peripheral ends of which is respectively molded a partially cylindrical wall as a rotor blade shoe, wherein the rotor blade shoes bear slidingly and sealingly against the cylindrical inner wall regions of the pump housing on the one hand, and against the rotor shafts of the adjacent rotor on the other hand.

In a particularly preferred embodiment, each rotor blade shoe has on the outer side of the partially-cylindrical wall at least one sealing scraping edge, which runs parallel to the rotor axis and which is disposed close to the, in the rotational direction, front edge of the respective partially cylindrical wall of the rotor blade shoe. This ensures that no deposits can build up on the housing wall.

BRIEF DESCRIPTION OF THE DRAWINGS

Further advantageous embodiments of the subject of the invention emerge from the dependent claims, and the significance and working method thereof are described in the following description with reference to the appended drawing In the drawing, a preferred illustrative embodiment of the subject of the invention is represented, wherein:

FIG. 3 shows once again the metering pump in a side view, the detachable pump housing wall having once again been omitted, while

DETAILED DESCRIPTION

Figure 1:
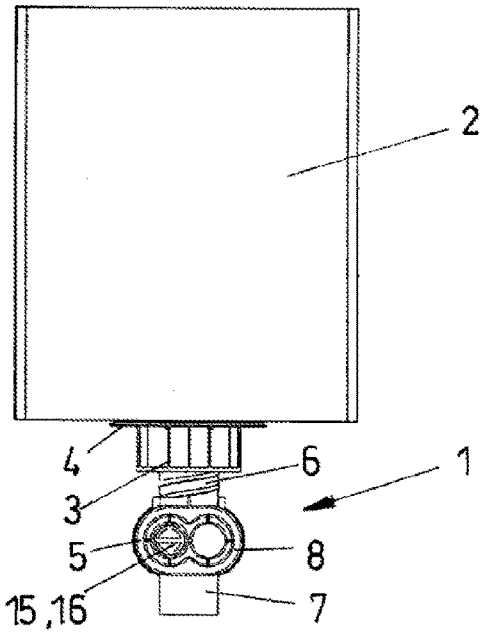
FIG. 1 shows a preferred use of the metering pump according to the invention, fitted on a tubular bag.

In FIG. 1, a preferred application of the metering pump according to the invention, which is denoted in its entirety by 1, is represented symbolically on a tubular bag 2. The metering pump 1 is held on the tubular bag 2 by means of a mounting socket 3 provided with a flange 4. The connection of the flange 4 to the tubular bag 2 is preferably realized by ultrasonic welding.

The metering pump itself possesses a pump housing 5 having a suction port 6 and an outlet port 7. The suction port 6 is screw-connected to the mounting socket 3. The metering pump itself is here shown with a view onto a fixed end wall 8 of the pump housing 5, wherein a rotor shaft end 15, provided with a drive coupling part 16, here projects through the aforementioned fixed end wall 8 and the drive coupling unit 16 can be seen. The drive coupling part serves for positive connection to a drive means (not represented here).

Figure 2:
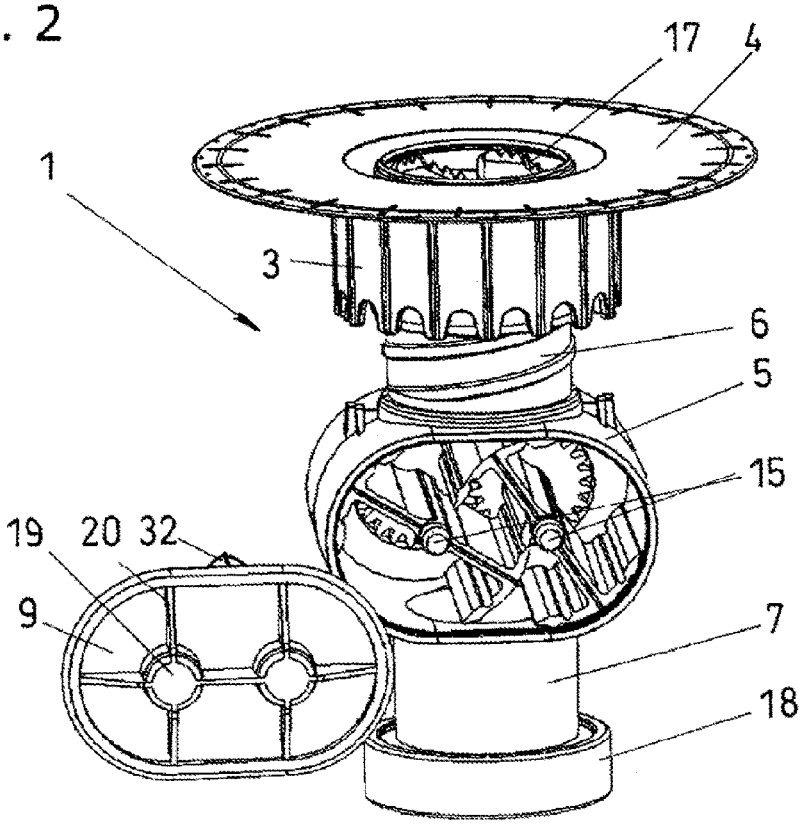
FIG. 2 shows a perspective view of the metering pump with the mounting socket, the detachable pump housing wall having been removed.

In FIG. 2, the metering pump 1 with the mounting socket is represented in isolation. In this perspective view, one looks obliquely from above onto the aforementioned flange 4 and recognizes opening means 17, which are here configured as perforating and cutting teeth and in this position, prior to first use, still lie fully within the suction port 6. Prior to first use, the pump housing 5 will be screwed with its suction port 6 in the mounting socket 3 up to a stop, wherein the aforementioned opening means 17 cut open an aseptically closed container, preferably a tubular bag made of plastics sheet. In the here represented transport position of the metering pump 1, the outlet port 7 is provided, moreover, with a closing cap 18, which ensures that no foreign substances or foreign particles can get into the metering pump during transport and storage.

In FIG. 2, the pump housing 5 is represented open. While in FIG. 1, as already mentioned, one looks onto the fixed end wall 8 of the pump housing 5, here the metering pump 1 is represented rotated through 180° and one looks onto that side of the metering pump 1 which has a detachable end wall 9. This detachable end wall 9 is shown laterally offset or loosened. The detachable end wall 9 can also be referred to as the pump housing cover. In this figure, one looks onto the outer side of the pump housing cover and recognizes outwardly protruding, closed bearing bushes 19, which on the inner side are capable of receiving the rotor shaft ends 15. The outwardly closed bearing bushes 19 are held stabilized with stiffening ribs 20 on the outer side of the detachable end wall 9.

Figure 3:
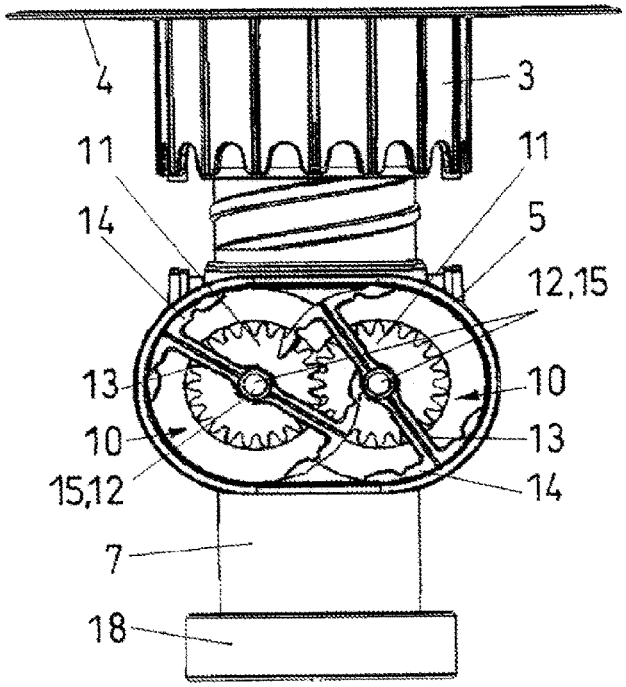

In FIG. 3, the metering pump 1 is shown in the side position, yet in the same usage position as in FIG. 2, yet with the omission of the detachable end wall of the pump housing 5. In this view, the two rotors 10 which are mounted in the pump housing 5 and onto which gearwheels 11 are molded, preferably in one piece, which gearwheels cause the two rotors, when one of the two rotors is driven, to move in opposite directions, can clearly be seen. With respect to the exact configuration of the two rotors 10, reference is made to the following FIG. 4. In FIG. 3, it can be seen that each rotor is provided with a rotor shaft 12, wherein one here looks onto the rotor shaft ends 15, and wherein two mutually diametrically opposing rotor blade walls 13 are respectively molded onto the rotor shafts 12. Onto the peripheral ends of the rotor blade walls 13 is respectively molded a rotor blade shoe 14. Each rotor blade shoe possesses a partially cylindrical shape, which is matched in curvature to the cylindrical part of the pump housing 5. As can here be seen, each rotor blade shoe 14 bears constantly either on the inner side of the pump housing or against the rotor shaft 12 of the adjacent rotor.

Figure 4:
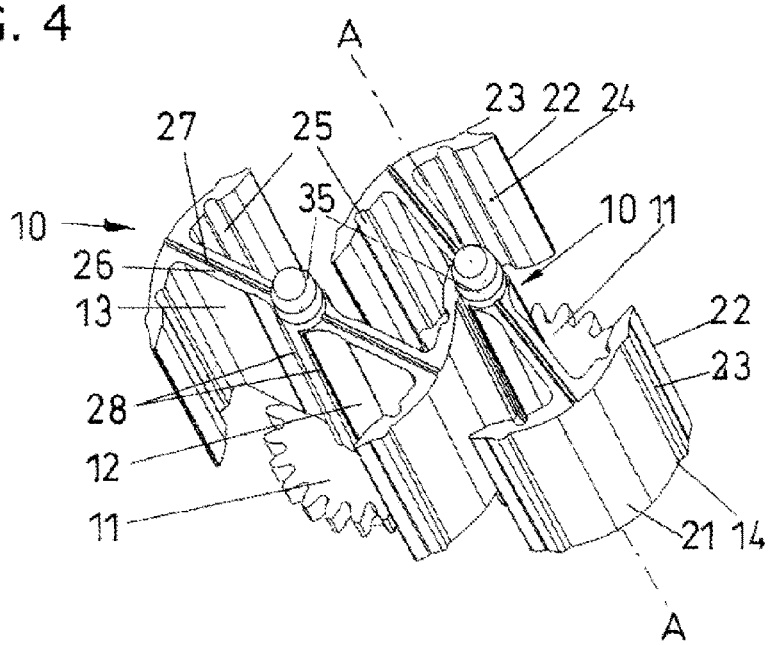
FIG. 4 shows the two rotors in isolation in correct relative position to each other in perspective view.

In FIG. 4, the design of the two rotors can now be seen in detail. These are represented in isolation in a correct relative position as provided during installation, though with the omission of the pump housing 5. Those parts which have already been mentioned in connection with FIG. 3, namely the rotor shaft 12 or the corresponding rotor shaft ends 15, are not identified again here, so as thus not to burden the figure unnecessarily. The specific embodiment of the rotor blade shoes 14 is particularly clearly visible in this figure. As already mentioned, the rotor shoes 14 are molded in one piece onto the peripheral ends of the rotor blade walls 13. The rotor blade shoes have a partially cylindrical outer face 21. The radius of curvature of this outer face corresponds to the distance between the axis A, passing through the middle of the rotor shaft 12 and running in the longitudinal direction thereof, and the outer face 21 of the rotor blade shoes.

The metering pump according to the invention is preferably designed at least practically such that the pump seals the connection between the suction port and the outlet port. To this end, the pump, or its rotors, and the pump housing 5, have a multiplicity of different sealing elements. At the same time, these sealing elements also have a cleaning effect and prevent deposits in the pump housing, which deposits can lead to a reduction in quality and to leaks, as well as, in the worst case, to blockages of the pump.

Accordingly, the rotor blade shoes 14 have at least in the radial direction, close to the, in the direction of rotation, front edge, a sealing scraping edge 23. This sealing scraping edge 23 has substantially the shape of a bead, which on the aforementioned outer face 21 runs parallel to the rotor shaft 12. As the name says, the sealing scraping edge 23 serves, on the one hand, to form a seal between the inner cylindrical wall parts of the pump housing 5 and the rotor 10, while, at the same time, this sealing scraping edge 23 is meant, by virtue of its scraping action, also to avoid the formation of deposits. Preferably, each rotor blade shoe 14 is provided with two sealing scraping edges 23, namely both in the direction of the leading end edge 22 and close to the trailing end edge 22. These edges are both times referred to as an end edge 22, since preferably both rotors 10 are designed absolutely identically in order thus to require only one injection mold. This also has the advantage that, if the two rotors are designed the same, no source of error arises in the assembly.

The sealing scraping edge 23, which preferably has a roughly triangular shape in cross section, leads the outer face 21 to no longer bear fully against the inner wall of the pump housing 5. However, the rotor blade shoes 14 are also required to be deformed in the outer region. In order to facilitate this deformation and thus achieve an elastic contact pressure of the sealing scraping edges 23, joint grooves 25 are made on the inner face 24. These joint grooves 25 are located closer to the rotor blade walls 13 than the sealing scraping edges 23 disposed on the opposite side. The joint grooves 25 thus permit an elastic articulated movement of the corresponding end edges 22 pivotably about the joint groove 25. If sealing scraping edges 23 are molded onto both ends of the rotor blade shoes, on the outer faces 21, then corresponding joint grooves 25 are made, of course, on both sides of the inner face 24.

In FIG. 4, it can additionally be seen that the rotor blade walls 13 possess end faces 26. On the end faces 26, which, in the installed state of the rotors in the pump housing 5, are positioned toward the detachable end wall 25 or of the pump housing cover, are respectively arranged a sealing lip 27, extending centrally from the rotor shaft ends to the outer face 21 of the rotor blade shoes. On the opposite end side, which is not visible here, the gearwheels fit connected in one piece to these end faces. Here, such sealing lips will be fitted to the corresponding end face sections such that they run only from the corresponding gearwheel up to the outer face 21 of the rotor blade shoes.

In order also that the rotor blade shoes 14 are sealed with respect to the rotor shaft 12, longitudinal stripping ribs 28 are also fitted on the rotor shaft 12. These longitudinal stripping ribs 28 run parallel to the axis A of the rotor shaft. In principle, it is here sufficient to fit respectively one longitudinal stripper rib 28 on each rotor shaft, though preferably two such longitudinal stripper ribs are respectively fitted on the same side, so that the region between the rotor blade walls 13 is divided roughly into three. These longitudinal stripper ribs 28 not only have a sealing effect, but also clean the rotor blade shoes 14, on the outer side 21 thereof, of any deposits which form there. By virtue of these design features, a self-cleaning metering pump is practically formed.

Figure 5:
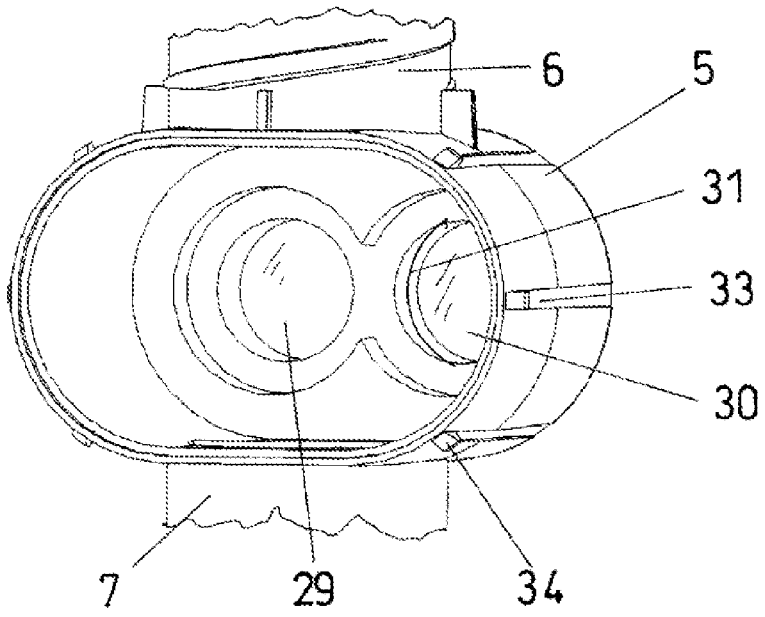
FIG. 5 represents a perspective partial view of the pump housing in isolation.

In FIG. 5, the pump housing 5 is represented in isolation. The suction port 6 and the outlet port 7 are only to some extent visible. In this solution too, the pump housing cover, or the detachable end wall of the pump housing, is once again removed. One thus looks onto the inner side of the fixed end wall 8 of the pump housing. Second bearing sleeves 29, 30 are molded herein, wherein one second bearing sleeve 29 is of closed design and the other, second bearing sleeve 30 is continuously open to the outside. In this open bearing sleeve 30, a circumferential sealing lip 31 of lesser height is preferably molded. A plurality of such circumferential sealing lips 31 can also, however, be present and so practically form a type of labyrinth seal.

The rotors 10 thus have on their rotor shafts 12, on both sides, rotor shaft ends 15, which are designed as rotor shaft journals. The rotor shaft journals on the side of the pump housing cover 9 have a smaller diameter, while the rotor shaft ends on the other side have a substantially larger diameter. Since, as already mentioned, the two rotors are preferably, however, of identical design, both rotors also have at that rotor shaft end having the greater diameter a so-called drive coupling part 16, which has already been described with reference to FIG. 1. While, in FIG. 1, the open bearing sleeve 30 is disposed on the left and thus the drive coupling part 16 can be seen there, in FIG. 1 the closed bearing sleeve 29 is represented on the right. In FIG. 5, in which the pump housing is now seen from the inner side, the closed, second bearing sleeve 29 can consequently be seen on the left and the second, open bearing sleeve 30 on the right. Only in the second, open bearing sleeve 30 will the corresponding circumferential sealing lip 31 be fitted.

Figure 6:
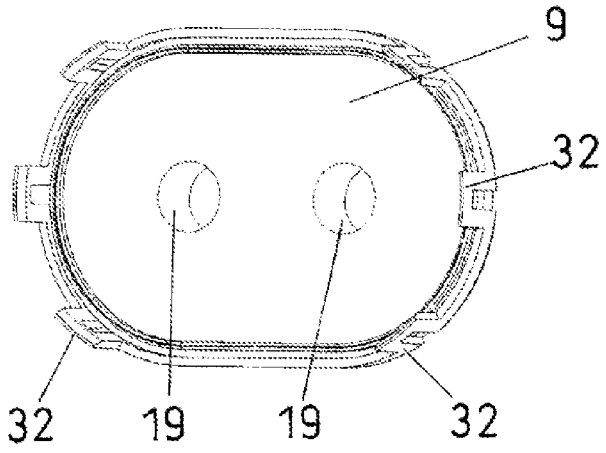
FIG. 6 represents the detachable pump housing wall in perspective view looking onto its inner side.

In FIG. 6, the detachable end wall 9 or pump housing cover 9 is now represented in isolation. On the circumferential rim can be seen a plurality of spring tongues 32, which on the outside of the pump housing 5, in the closed state of the pump housing cover, hook onto the latching means 33 with corresponding cams 34. In FIG. 2, an alternative form for the fastening of the detachable end wall 9 is represented. Here, on the inner side of the pump housing cover 9 are molded two spring tongues, which are substantially more stable in design and are configured practically as a displacement body, which penetrates into the pump housing in that region which is not covered by the two rotors. Here it is also possible, of course, to provide corresponding latching means on the rotor housing. Even in that marginal region, the formation of deposits is thus made very nearly impossible. Further inward, the openings of the suction port 6 and outlet port 7 are present, where no deposits can anyway form. These somewhat more stable spring tongues 32 can accordingly have latching means, which are not visible here and which, instead of behind cams, can engage behind the edges of the inner side of the suction ports 6 or outlet ports 7.

As already mentioned, bearings are molded also in the detachable end wall 9. These are here, however, referred to as closed bearing bushes 19. Since these bearing bushes 19 are closed, no additional sealing means are necessary here. The diameter of these closed bearing bushes 19 is substantially smaller than the diameter of the two bearing sleeves 29 and 30. In these closed bearing bushes 19 engage the rotor shaft ends 15, which are designed as bearing journals 30, as can most clearly be seen in FIG. 4.

Figure 7:
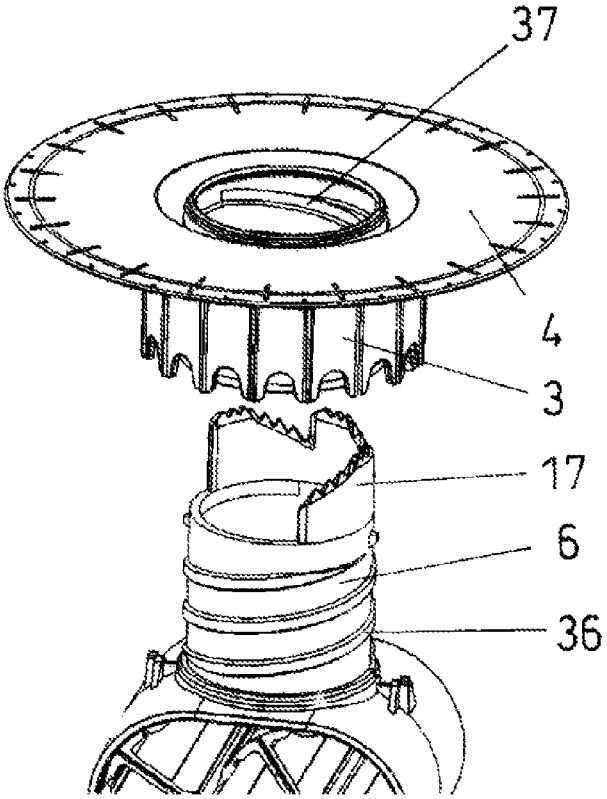
FIG. 7 shows, finally, the inlet port of the metering pump with an opening means and a mounting socket with flange for welded connection to a tubular bag.

Finally, reference is made to FIG. 7, in which the mounting socket 3 with the flange 4 can be seen represented separate from the suction port 6. Here the opening means 17 are also clearly visible, which are molded in one piece onto the suction port 6. The suction port 6 further has an external thread 36. This external thread 36 fits with the internal thread 37 in the mounting socket 3.

With the metering pump 1 which is described here, fluids, as well as mixtures of fluids and solids, can be pumped without difficulty. The size of the solid particles is here practically immaterial, though they must of course be smaller in size than the distance between the two roller shafts. Whether the solid parts are coarse-grained or fine-grained, however, and are thus more or less strongly inclined to form deposits, is immaterial. Firstly, the solid parts are not ground and, secondly, as a result of the previously described means, the depositing thereof on the pump housing, as well as on the rotor blade shoes or on the rotor shafts, is continually removed. It is thereby ensured that the metering pump, which serves as a disposable metering pump, will always work reliably for the service life which is necessary. Since, by virtue of the previously described design, a tight seal exists between the outlet port 7 and the tubular bag 2, a practically aseptic state is maintained in the tubular bag throughout the emptying operation. Accordingly, the food which is supplied in the fully closed aseptic tubular bag can be offered without, or at least with substantially less preservatives.

The invention claimed is:

1. A metering pump (1), made of plastic, comprising two rotors (10), which are coupled to one another via gearwheels (11) and are drivable in opposite directions and which are mounted in a pump housing (5) provided with a suction port (6) and an outlet port (7), wherein each of the rotors (10) has a rotor shaft (12), rotor shaft ends (15) of which are seated in walls (8, 4) of the pump housing (5), and a rotor shaft axis (A), characterized in that each of the rotors (10) has two rotor blade walls (13), which are disposed diametrically on the rotor shaft (12) and onto peripheral ends of which are respectively molded partially cylindrical rotor blade shoes (14), wherein the rotor blade shoes (14) bear slidingly and sealingly against cylindrical inner wall regions of the pump housing (5), on the one hand, and against the rotor blade shafts (13) of the adjacent rotor (10), on the other hand, wherein the pump has an end wall (8) fixedly connected to the pump housing (5) and a detachable end wall (9), wherein the end wall (8) fixedly connected to the pump housing (5) defines both an open bearing sleeve (30) and an outwardly closed bearing sleeve (29), wherein at least one rotor shaft end (15) has a drive coupling part (16), which passes through the pump housing (5) and passes through the end wall fixedly connected to the pump housing (5), wherein both of the rotors (10) are identical and both thus have one of the drive coupling parts (16), and wherein one of the drive coupling parts (16) is seated in the open bearing sleeve (30) and the other drive coupling part (16) is seated in the outwardly closed bearing sleeve (29).

2. The metering pump as claimed in claim 1, wherein the metering pump is disposable.

3. The metering pump as claimed in claim 1, wherein one of the respective gearwheels (11) is molded in one piece onto one of the rotor shafts (12), and another of the respective gearwheels (11) is molded in one piece onto the other rotor shaft (12).

4. The metering pump (1) as claimed in claim 1, characterized in that each of the rotor blade shoes (14) has on an outer face (21) at least one leading sealing scraping edge (23), which runs parallel to the rotor axis (A) and which is disposed close to, in a rotational direction, a leading end edge (22) of a respective rotor blade shoe (14).

5. The metering pump (1) as claimed in claim 4, characterized in that on each rotor blade shoe (14) is respectively disposed a trailing sealing scraping edge (23), which runs parallel to the rotor axis (A) and is close to a trailing end edge (22) of the respective rotor blade shoe.

6. The metering pump (1) as claimed in claim 5, characterized in that, in a region between each leading and trailing sealing scraping edge (23) and the rotor blade wall (13), a joint groove (25) is disposed on an inner face (24) of the rotor blade shoe (14), the inner face being on a side of the rotor blade shoe opposite the outer face.

7. The metering pump (1) as claimed in claim 1, characterized in that into the open bearing sleeve (30) is molded, in one piece, at least one circumferential sealing lip (31).

8. The metering pump (1) as claimed in claim 1, characterized in that on the two rotor blade walls (13) of each rotor (10), in end sides (26) remote from the gearwheels (11), is provided at least one sealing lip (27) for sealing contact against the detachable end wall (9) of the pump housing (5).

9. The metering pump (1) as claimed in claim 1, characterized in that between the two rotor blade walls (13) of each rotor (10), on both sides of the rotor shaft (12), are arranged two parallel longitudinal stripping ribs (28).

10. The metering pump (1) as claimed in claim 1, characterized in that the suction port (6) is provided with cutting and/or perforating opening means (17) and a mounting socket (3) with a flange (4), which mounting socket is configured to be welded onto a container wall.

11. The metering pump (1) as claimed in claim 1, characterized in that the outlet port (7) is provided with a closing cap (18).

12. The metering pump (1) as claimed in claim 1, characterized in that closed bearing bushes (19) for both rotors (10) are molded into the detachable end wall (9) of the pump housing (5).

* * * * *